US008744319B2

(12) United States Patent
Maehara et al.

(10) Patent No.: US 8,744,319 B2
(45) Date of Patent: Jun. 3, 2014

(54) DEVELOPING DEVICE AND IMAGE FORMING APPARATUS

(75) Inventors: Hiroyoshi Maehara, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 135 days.

(21) Appl. No.: 13/591,442

(22) Filed: Aug. 22, 2012

(65) Prior Publication Data

US 2013/0051860 A1 Feb. 28, 2013

(30) Foreign Application Priority Data

Aug. 23, 2011 (JP) ..... 2011-181758

(51) Int. Cl.
*G03G 15/08* (2006.01)

(52) U.S. Cl.
USPC ..... 399/254; 399/256

(58) Field of Classification Search
USPC ..... 399/107, 119, 120, 252–263
See application file for complete search history.

(56) References Cited

U.S. PATENT DOCUMENTS 7,979,007 B2 * 7/2011 Mihara et al. ..... 399/254
2001/0021324 A1 9/2001 Sugihara

FOREIGN PATENT DOCUMENTS

JP 2007-17526 1/2007
JP 2009-109741 5/2009

* cited by examiner

*Primary Examiner* — Hoan Tran
(74) *Attorney, Agent, or Firm* — Nixon & Vanderhye, P.C.

(57) ABSTRACT

A developing device has a developer tank for containing a two-component developer; a partition; a first and a second developer conveyance path for conveying the developer in pairs; a first conveyance member for conveying the developer in one direction, which has a first rotation axis, a first helical blade fixed to the first rotation axis, and a first passive gear provided to an end of the first rotation axis; a second conveyance member for conveying the developer in one direction, which has a second rotation axis, a second helical blade fixed to the second rotation axis, and a second passive gear provided to an end of the second rotation axis; a first communicating path; a second communicating path; a developing roller; and a rotation axis bending prevention belt provided so as to bridge the first and the second rotation axis outside the developer tank.

6 Claims, 8 Drawing Sheets

DEVELOPING DEVICE AND IMAGE FORMING APPARATUS

CROSS-REFERENCE TO RELATED APPLICATION

This application is related to Japanese Patent Application No. 2011-181758 filed on Aug. 23, 2011, whose priority is claimed under 35 USC §119, and the disclosure of which is incorporated by reference in its entirety.

BACKGROUND OF THE INVENTION

1. Field of the Invention

The present invention relates to a developing device and an image forming apparatus for image formation with a two-component developer including a toner and a magnetic carrier.

2. Description of the Related Art

Conventionally, electrophotographic image forming apparatuses such as copying machines, printers and facsimile machines have been known. In an electrophotographic image forming apparatus, an electrostatic latent image is formed on a surface of a photoconductor, a toner is supplied to the electrostatic latent image by means of a developing device to develop the electrostatic latent image, a toner image formed through the development is transferred and fixed onto a sheet such as a paper sheet.

In recent years, for a full-color compliant image forming apparatus and a high-definition compliant image forming apparatus, a developer (hereinafter, also referred to as a "two-component developer") is often used which is excellent in toner charging stability. The two-component developer includes a toner and a carrier. The toner and the carrier are agitated in a developing device to generate friction between the toner and the carrier, and the friction allows the toner to be appropriately charged. The charged toner is supplied to a surface of a two-component developer holder (developing roller). The toner on the two-component developer holder is moved, by electrostatic attraction, to an electrostatic latent image formed on an image carrier (photoconductor). Thus, a toner image is formed on the photoconductor.

Since image forming apparatuses are required to be more high-speed and downsized, it is necessary to quickly perform sufficient charging of a two-component developer and to quickly convey the two-component developer.

In conventional image forming apparatuses, therefore, a circulative developing device in which a two-component developer is conveyed in a circulating manner has been employed in order to instantly disperse a supplementary toner into the two-component developer to give an appropriate amount of charge.

The circulative developing device, as disclosed in Japanese Unexamined Patent Application Publication No. 2001-255723, has two conveyance paths and two conveyance screws in a developer case, in which the conveyance paths allow a two-component developer to be conveyed and circulated therethrough, and the conveyance screws are respectively disposed in the conveyance paths to simultaneously agitate and convey the two-component developer. When the toner concentration of the two-component developer in the developing device falls below a predetermined value, toner is supplied to one conveyance path by a toner supply screw, and the toner supplied and the two-component developer are conveyed while being agitated.

In addition, Japanese Unexamined Patent Application Publication No. 2009-109741 proposes a developing device including, in a housing for containing a developer, a first agitation and conveyance screw, a second agitation and conveyance screw, and a developing roller, wherein the first and second agitation and conveyance screws each have a helical blade and a reverse helical blade having a phase (pitch) moving reversely to the helical blade, and the reverse helical blade is disposed at an downstream side end of the screw in the developer conveyance direction and has a through hole.

In this developing device, each reverse helical blade reversely conveys the developer and returns the developer through the through hole to generate convection in the developer near the reverse helical blade, so that the developer in the dead space is agitated efficiently and generation of a pool of the developer is prevented.

In such a conventional developing device, an auger screw having a helical blade is used as a conveyance member. However, the rigidity of the rotation axis of the auger screw is easily reduced when the rotation axis is formed thin or the rotation axis is formed of resin.

The reduced rigidity causes the auger screw to bend and therefore, in some cases, the helical blade is brought into contact with an inner wall of a developer tank. In such cases, toner stuck between the auger screw and the inner wall is aggregated to cause image defects such as insufficient image transfer.

SUMMARY OF THE INVENTION

The present invention provides a developing device and an image forming apparatus in which bending of a conveyance member can be prevented even the rotation axis of the conveyance member has low rigidity.

The present invention is a developing device comprising: a developer tank for containing a two-component developer; a partition for dividing an internal space of the developer tank; a first developer conveyance path and a second developer conveyance path which are separated by the partition and arranged in parallel for conveying and circulating the two-component developer in pairs, a first conveyance member provided in the first developer conveyance path in a freely rotatable manner for conveying the two-component developer in one direction, the first conveyance member having: a first rotation axis; a first helical blade fixed to the first rotation axis; and a first passive gear provided to an end of the first rotation axis extended out of the developer tank; a second conveyance member provided in the second developer conveyance path in a freely rotatable manner for conveying the two-component developer in one direction, the second conveyance member having: a second rotation axis; a second helical blade fixed to the second rotation axis; and a second passive gear provided to an end of the second rotation axis extended out of the developer tank; a first communicating path for guiding the two-component developer in the first developer conveyance path to the second developer conveyance path; a second communicating path for guiding the two-component developer in the second developer conveyance path to the first developer conveyance path; a developing roller for bearing and supplying the two-component developer in the second developer conveyance path to a photoconductor drum; and a rotation axis bending prevention belt provided so as to be put around with tension applied the first rotation axis and the second rotation axis outside the developer tank.

According to the present invention, the distance between the two rotation axes of the conveyance members is kept constant by the rotation axis bending prevention belt even when the rotation axes have low rigidity, and therefore the conveyance members can be prevented from bending when driven and rotated. As a result, the conveyance members are prevented from contacting with the inner wall of the developer tank to prevent toner aggregation.

DESCRIPTION OF THE PREFERRED EMBODIMENTS

Figure 1:
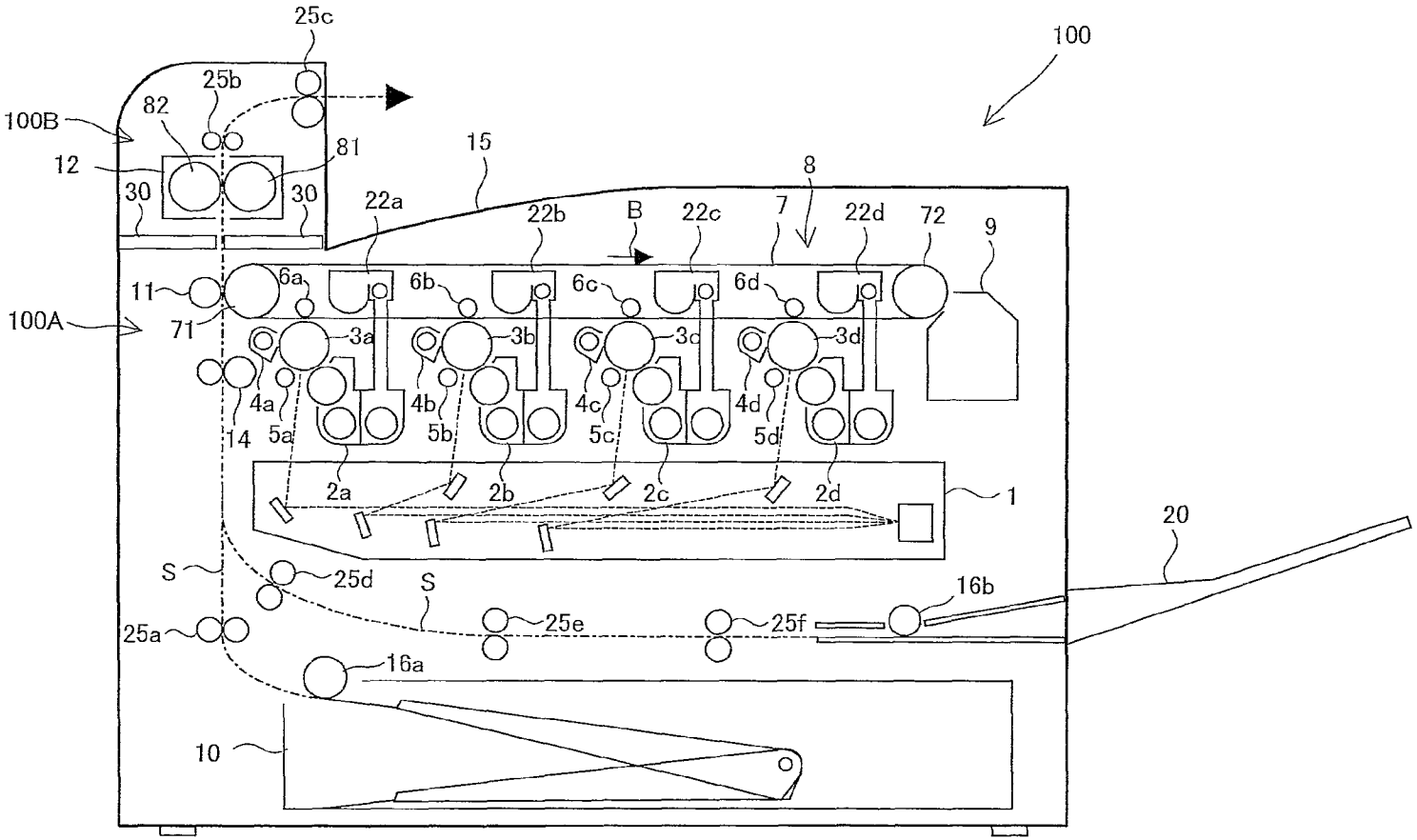
FIG. 1 is an explanatory diagram illustrating a general configuration of an embodiment of an image forming apparatus including a developing device of the present invention.

The present invention is a developing device comprising: a developer tank for containing a two-component developer; a partition for dividing an internal space of the developer tank; a first developer conveyance path and a second developer conveyance path separated by the partition and arranged in parallel for conveying and circulating the two-component developer in pairs, a first conveyance member provided in the first developer conveyance path in a freely rotatable manner for conveying the two-component developer in one direction, the first conveyance member having: a first rotation axis; a first helical blade fixed to the first rotation axis; and a first passive gear provided to an end of the first rotation axis extended out of the developer tank; a second conveyance member provided in the second developer conveyance path in a freely rotatable manner for conveying the two-component developer in one direction, the second conveyance member having: a second rotation axis; a second helical blade fixed to the second rotation axis; and a second passive gear provided to an end of the second rotation axis extended out of the developer tank; a first communicating path for guiding the two-component developer in the first developer conveyance path to the second developer conveyance path; a second communicating path for guiding the two-component developer in the second developer conveyance path to the first developer conveyance path; a developing roller for bearing and supplying the two-component developer in the second developer conveyance path to a photoconductor drum; and a rotation axis bending prevention belt provided so as to bridge the first rotation axis and the second rotation axis outside the developer tank.

In the developing device of the present invention, the first conveyance member and the second conveyance member include a first pulley and a second pulley fixed to the first rotation axis and the second rotation axis, respectively, and the rotation axis bending prevention belt is provided so as to contact with circumferences of the first and second pulleys.

According to the present invention, the rotation axis bending prevention belt is laid so as to contact with the circumferences of the first and second pulleys, and therefore the rotation axis bending prevention belt can be prevented from meandering, and the effect of preventing the bending of the conveyance members can be more stable.

In the developing device of the present invention, the first and second pulleys are disposed adjacent to the first and second passive gears, respectively.

According to the present invention, the rotation axis bending prevention belt is provided adjacent to the passive gears, which are subjected to the force that causes the bending of the conveyance members, and therefore the conveyance members can be prevented from bending more surely.

The present invention is a image forming apparatus, comprising: a photoconductor drum having a surface on which an electrostatic latent image is formed; a charger for charging the surface of the photoconductor drum; an exposure device for forming the electrostatic latent image on the surface of the photoconductor drum; a toner supplying device for supplying a toner to the developing device; a drive gear for driving the first and second passive gears of the developing device; a transfer device for transferring, to a recording medium, a toner image formed on the surface of the photoconductor drum by the developing device with the toner supplied from the toner supplying device; and a fixing device for fixing the transferred toner image onto the recording medium.

According to the present invention, the bending of the conveyance members can be prevented effectively, and therefore toner aggregation due to contact between the conveyance members and the inner wall of the developer tank can be prevented to prevent image defects such as insufficient image transfer.

In the image forming apparatus of the present invention, the drive gear is disposed between the first and second passive gears so as to engage with the passive gears.

According to the present invention, the two passive gears are driven to be rotated in a direction opposite to the rotation direction of the drive gear, and the movement of the two passive gears is limited by the rotation axis bending prevention belt, which limits the movement in directions of increasing the distance between the passive gears, and the drive gear disposed between the passive gears. Thus, the distance between the two rotation axes is kept constant, and the bending of the conveyance members can be minimized.

According to the present invention, the distance between the two rotation axes is kept constant by the rotation axis bending prevention belt, and therefore the two conveyance members can be prevented from bending when driven and rotated.

As a result, the conveyance members are prevented from contacting with the inner wall of the developer tank to prevent toner aggregation due to the contact.

Hereinafter, embodiments of a developing device and an image forming apparatus of the present invention will be described in detail with reference to the drawings. It should be noted that the present invention is not limited thereto.

<Configuration of Image Forming Apparatus>

FIG. 1 is an explanatory diagram illustrating a general configuration of an embodiment of an image forming apparatus including a developing device of the present invention.

An image forming apparatus 100 mainly comprises: a developing device housing 100A accommodating a plurality of developing devices 2*a* to 2*d* in a casing; a fuser housing 100B accommodating a fuser (fixing device) 12 above the developing device housing 100A in the casing; and a partition 30 provided between the developing device housing 100A and the fuser housing 100B to insulate heat of the fuser 12 to prevent the heat from being transferred to a developing device side.

The image forming apparatus 100 forms a multicolor or monochrome image on a sheet-like recording medium (recording paper) according to image data transmitted from an external source. An upper surface of the developing device housing 100A, located beside the fuser housing 100B in FIG. 1, constitutes a sheet exit tray 15.

In the embodiment in FIG. 1, the image forming apparatus is a printer by way of example. Alternatively, the image forming apparatus may be a copying machine, a facsimile machine or a multifunctional system having these functions, which can form a multicolor or monochrome image on a recording medium according also to externally-transmitted image data and/or image data scanned from a document by a scanner.

[Configuration of Developing Device Housing 100A]

As illustrated in FIG. 1, the developing device housing 100A includes: four photoconductor drums 3*a*, 3*b*, 3*c* and 3*d*; four chargers (charging devices) 5*a*, 5*b*, 5*c* and 5*d* for charging surfaces of the respective photoconductor drums 3*a* to 3*d*; an exposure unit (exposure device) 1 for forming electrostatic latent images on the surfaces of the respective photoconductor drums 3*a* to 3*d*; the four developing devices 2*a*, 2*b*, 2*c* and 2*d* for individually containing black, cyan, magenta and yellow toners and developing the electrostatic latent images on the surfaces of the respective photoconductor drums 3*a* to 3*d* to form toner images; four cleaner units 4*a*, 4*b*, 4*c* and 4*d* for removing residual toners left on the surfaces of the respective photoconductor drums 3*a* to 3*d* after the development and the image transfer; four toner supplying devices 22*a*, 22*b*, 22*c* and 22*d* for individually supplying the four colors of toners to the respective developing devices 2*a* to 2*d*; an intermediate transfer belt unit (transfer device) 8 for transferring the toner images on the surfaces of the respective photoconductor drums 3*a* to 3*d* to a recording medium; and an intermediate transfer belt cleaning unit 9.

The reference numeral a represents members for black image formation, the reference numeral b represents members for cyan image formation, the reference numeral c represents members for magenta image formation, and the reference numeral d represents members for yellow image formation.

In the image forming apparatus 100, a black toner image, a cyan toner image, a magenta toner image and a yellow toner image are selectively formed on the surfaces of the photoconductor drums 3*a*, 3*b*, 3*c* and 3*d* based on image data of the four color components of black (K), cyan (C), magenta (M) and yellow (Y), respectively. The toner images formed are superimposed on each other on the intermediate transfer belt unit 8 to form one color image on a recording medium.

Hereinafter, the photoconductor drums 3*a* to 3*d* corresponding to the respective colors will be collectively described with a reference numeral 3 as having the same configuration. Likewise, the developing devices will be denoted by a reference numeral 2, the chargers will be denoted by a reference numeral 5, the cleaner units will be denoted by a reference numeral 4, and the toner supplying devices will be denoted by a reference numeral 22 in the following description.

The developing device, which constitutes a characteristic configuration of the present invention, will be described later.

The photoconductor drum 3 includes a conductive base body and a photoconductive layer formed on a surface of the base body, and the photoconductor drum 3 is a cylindrical member that forms a latent image by charge and exposure. The photoconductor drum 3 exhibits a conductive property in response to exposure to light, and an electric image called electrostatic latent image is formed on the surface thereof. The photoconductor drum 3 is supported by drive means, not shown, such that it can rotate about its axis.

Under the photoconductor drum 3, disposed are the four developing devices 2 for forming images in the different colors.

The cleaner unit 4 removes and collects toner left on the surface of the photoconductor drum 3 after development and image transfer processes.

The charger 5 is to uniformly charge the surface of the photoconductor drum 3 at a predetermined potential. As the charger 5, a contact brush type charger, a non-contact type charger, or the like may be used other than the contact roller type charger shown in FIG. 1.

The exposure unit 1 applies light according to image data to the surface of the charged photoconductor drum 3 from below the charger 5 and the developing device 2 to perform exposure, thereby forming an electrostatic latent image according to the image data on the surface of the photoconductor drum 3.

In the present embodiment, as illustrated in FIG. 1, the exposure unit 1 is a laser scanning unit (LSU) that includes a laser irradiation section and reflective mirrors. Alternatively, an EL (electroluminescence) or LED writing head in which light emitting elements are arranged in an array may be used.

The exposure unit 1 is disposed under the developing device 2.

The intermediate transfer belt unit 8 includes: intermediate transfer rollers 6*a*, 6*b*, 6*c* and 6*d* (hereinafter, collectively described with a reference numeral 6); an intermediate transfer belt 7; an intermediate transfer belt driving roller 71; an intermediate transfer belt driven roller 72; and an intermediate transfer belt tension mechanism, not shown.

The intermediate transfer roller 6, the intermediate transfer belt driving roller 71, the intermediate transfer belt driven roller 72 and the intermediate transfer belt tension mechanism allow the intermediate transfer belt 7 to be laid across in a tensioned condition, and allow the intermediate transfer belt 7 to be driven to rotate in a direction of an arrow B in FIG. 1.

The intermediate transfer roller 6 is rotatably supported at intermediate transfer roller attaching parts of the intermediate transfer belt tension mechanism in the intermediate transfer belt unit 8. A transfer bias is applied on the intermediate transfer roller 6 in order to transfer a toner image from the photoconductor drum 3 onto the intermediate transfer belt 7.

The intermediate transfer belt 7 is disposed so as to be in contact with each photoconductor drum 3. Toner images of the respective color components formed on the photoconductor drum are sequentially transferred to and superimposed on the intermediate transfer belt 7 to form a color toner image (multicolor toner image). The intermediate transfer belt 7 is formed into an endless form by using, for example, a film having a thickness of approximately 100 μm to 150 μm.

The toner images are transferred from the photoconductor drum 3 to the intermediate transfer belt 7 by means of the intermediate transfer roller 6 that is in contact with an inside surface of the intermediate transfer belt 7. A transfer bias having a high voltage (high voltage having a polarity (+) reverse to a charge polarity (−) of the toner) is applied to the intermediate transfer roller 6 in order to transfer the toner images.

The intermediate transfer roller 6 is formed with a metal (for example, stainless steel) shaft having a diameter of, for example, 8 mm to 10 mm as a base, and the surface thereof is covered with an elastic material having conductivity (for example, EPDM or urethane foam). The conductive elastic material enables the intermediate transfer roller 6 to uniformly apply a high voltage to the intermediate transfer belt 7. In the present embodiment, a roller type transfer electrode (intermediate transfer roller 6) is used. Alternatively, a brush type transfer electrode or the like may be used.

As described above, the electrostatic latent images on the photoconductor drum 3 are individually made visible with the toners corresponding to the respective color components to be toner images. The toner images are superimposed on the intermediate transfer belt 7. The superimposed toner images are moved by the rotation of the intermediate transfer belt 7 to a contact position (transfer part) between the intermediate transfer belt 7 and a paper sheet that has been conveyed to this position, and transferred onto the paper sheet by a transfer roller 11 disposed at this position. Here, while the intermediate transfer belt 7 and the transfer roller 11 are being pressed against each other at a predefined nip, a voltage is applied to the transfer roller 11 for transferring the toner images to the paper sheet. This voltage is a high voltage having a polarity (+) reverse to the charge polarity (−) of the toner.

In order to steadily obtain the nip, either one of the transfer roller 11 or the intermediate transfer belt driving roller 71 is formed from a hard material such as a metal, and the other is formed from a flexible material such as the case with an elastic roller (for example, elastic rubber roller or formable resin roller).

Toners adhering to the intermediate transfer belt 7 due to the contact between the intermediate transfer belt 7 and the photoconductor drum 3; and toners that have not been transferred upon the transfer of the toner images from the intermediate transfer belt 7 to the paper sheet and that are remaining on the intermediate transfer belt 7 cause color mixture of the toners in a following process. Such toners are therefore removed and collected by the intermediate transfer belt cleaning unit 9.

The intermediate transfer belt cleaning unit 9 includes a cleaning blade (cleaning member) that is in contact with the intermediate transfer belt 7. The contact part of the intermediate transfer belt 7 with the cleaning blade is supported from a back side by the intermediate transfer belt driven roller 72.

The developing device housing 100A further includes: a sheet feed tray 10 disposed in a lowermost part of the developing device housing 100A for storing a plurality of recording media; a manual sheet feed tray 20 disposed on one side surface of the developing device housing 100A for receiving an irregular-size recording medium; and a sheet conveyance path S through which a recording medium is conveyed to the intermediate transfer belt unit (transfer device) 8 from the sheet feed tray 10 or the manual sheet feed tray 20.

The sheet conveyance path S guides a sheet from the sheet feed tray 10 and a recording medium from the manual sheet feed tray 20 to the sheet exit tray 15 via the transfer part and the fuser unit 12. The transfer part is located between the intermediate transfer belt driving roller 71 and the transfer roller 11.

Further, pickup rollers 16*a* and 16*b*, conveyance rollers 25*a* to 25*f*, a registration roller 14, the transfer part (transfer roller 11) and the fuser unit 12 are disposed along the sheet conveyance path S.

The conveyance rollers 25*a* to 25*f* are small-size rollers provided along the sheet conveying path S for facilitating and assisting the sheet conveyance. The pickup roller 16*a* is a pull-in roller provided at an end of the sheet feed tray 10 for feeding sheets from the sheet feed tray 10 to the sheet conveyance path S one by one. The pickup roller 16*b* is a pull-in roller provided in the vicinity of the manual sheet feed tray 20 for feeding sheets from the manual sheet feed tray 20 to the sheet conveyance path S one by one. The registration roller 14 is to temporarily hold a seat being conveyed through the sheet conveyance path S and convey the sheet to the transfer part in such a timely manner that a front end of the toner images on the intermediate transfer belt 7 and a front end of the sheet coincide.

[Configuration of Fuser Housing 100B]

As illustrated in FIG. 1, the fuser (fixing device) 12 accommodated in the fuser housing 100B includes: a heat roller 81 and a pressure roller 82 that rotate in directions opposite to each other while holding therebetween a recording medium having a toner image transferred thereto; the conveyance roller 25*b*; and the sheet ejection roller 25*c*.

The heat roller 81 is controlled by a controller, not shown, so as to be at a predetermined fusing temperature. The controller controls the temperature of the heat roller 81 based on a detection signal from a temperature detector, not shown.

The heat roller 81 having reached the fusing temperature and the pressure roller 82 are pressed against the recording medium to melt the toners, thereby fusing the toner image on the recording medium.

The recording medium having the toner image fused thereon is conveyed by the conveyance rollers 25*b* and 25*c* to a reverse sheet ejection path of the sheet conveyance path S, and ejected onto the sheet exit tray 15 with being reversed (i.e., with the toner image facing down).

<Configuration of Developing Device 2>

Figure 2:
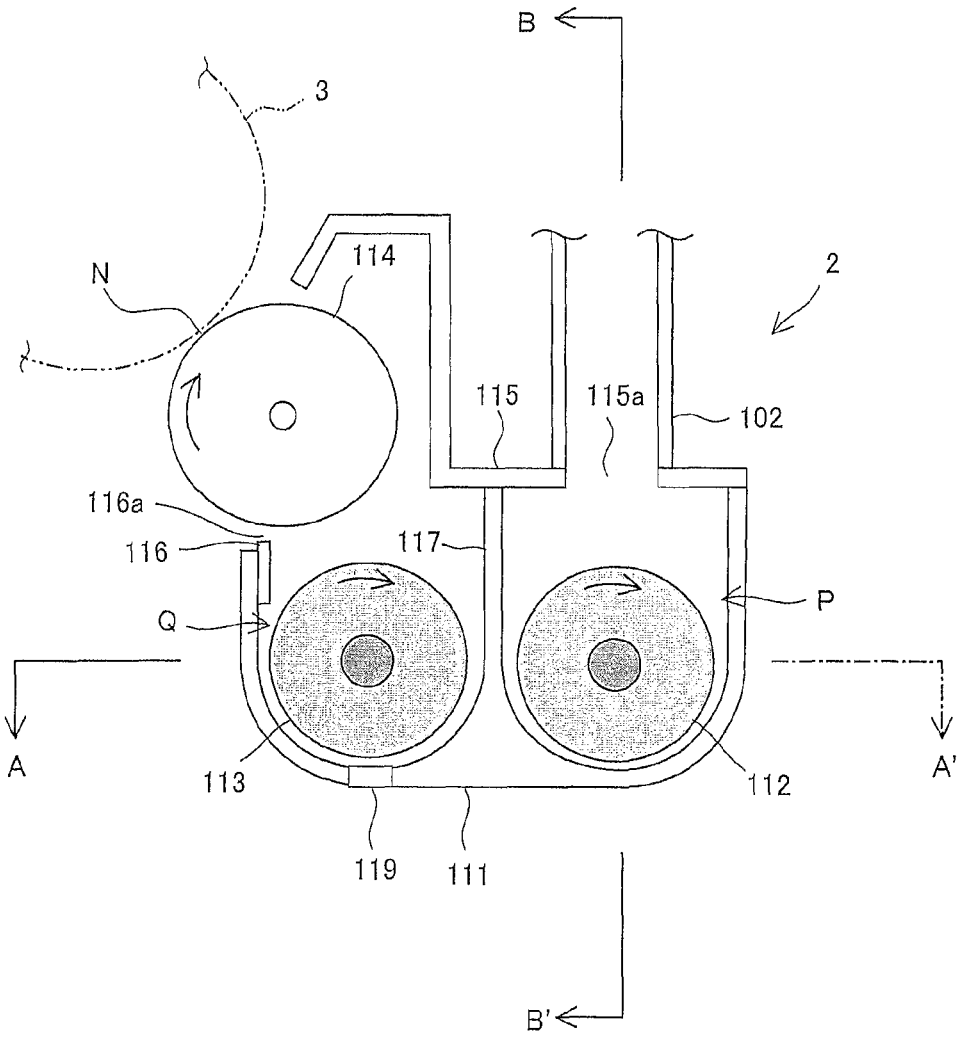
FIG. 2 is a schematic cross sectional view of the developing device in the image forming apparatus illustrated in FIG. 1.
Figure 3:
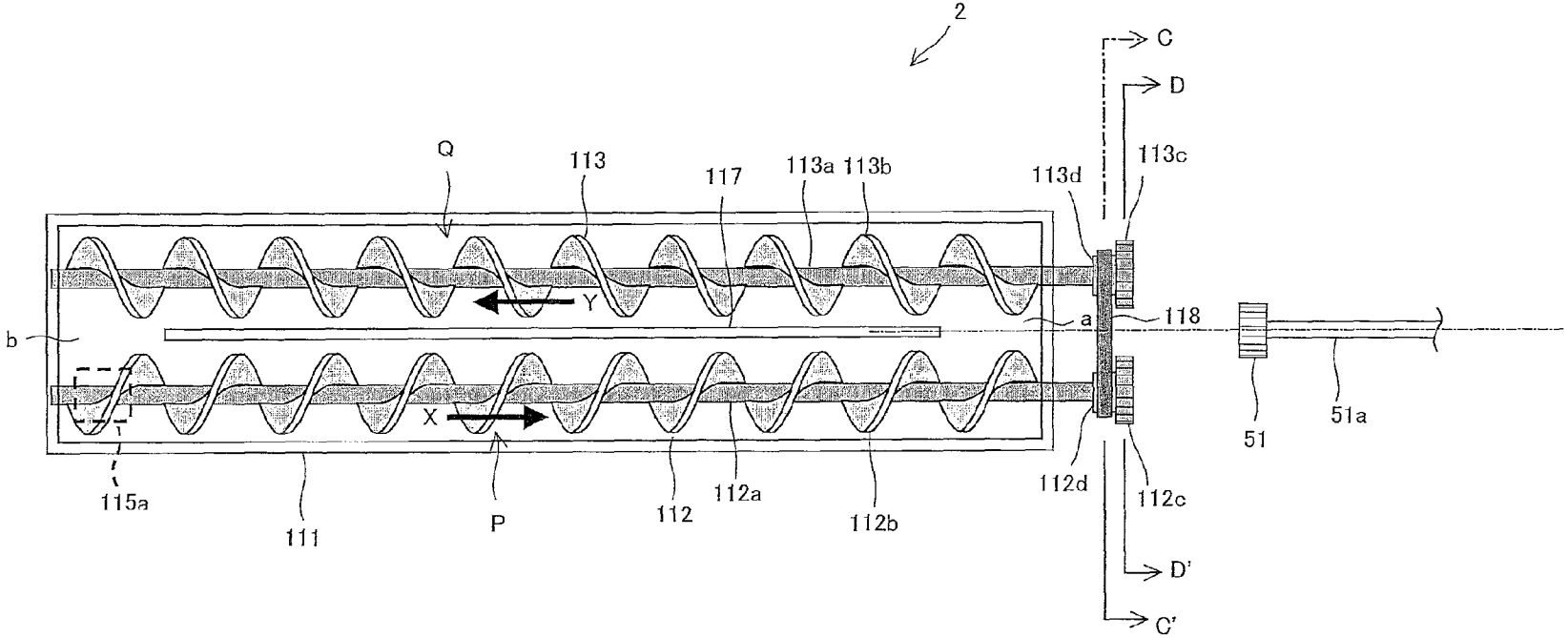
FIG. 3 is a sectional view of the developing device taken along a line A-A' in FIG. 2.
Figure 4:
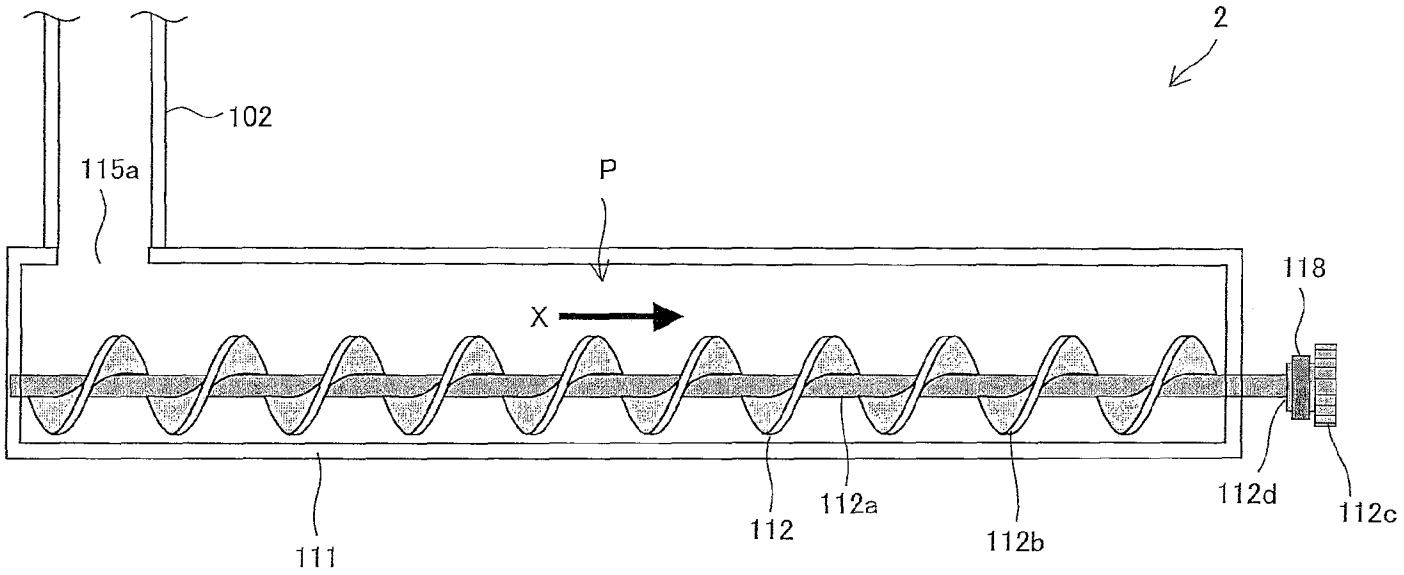
FIG. 4 is a sectional view of the developing device taken along a line B-B' in FIG. 2.
Figure 5:
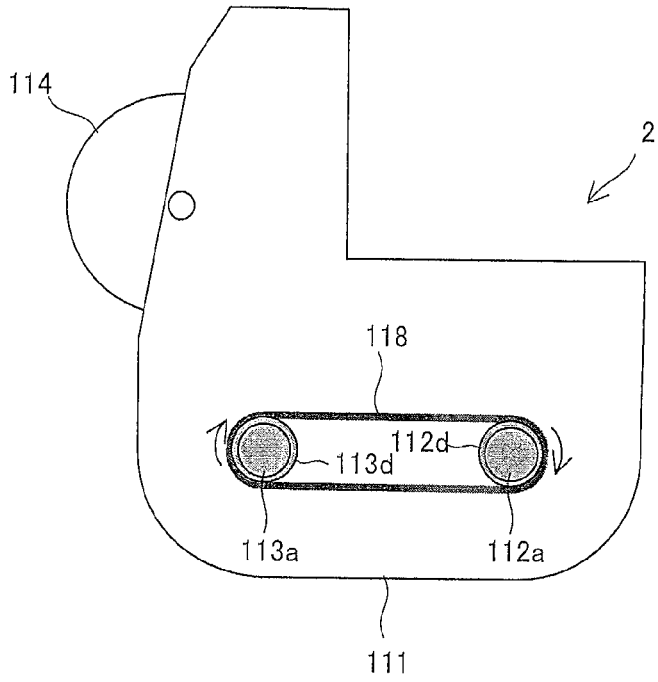
FIG. 5 is a sectional view of the developing device taken along a line C-C' in FIG. 3.
Figure 6:
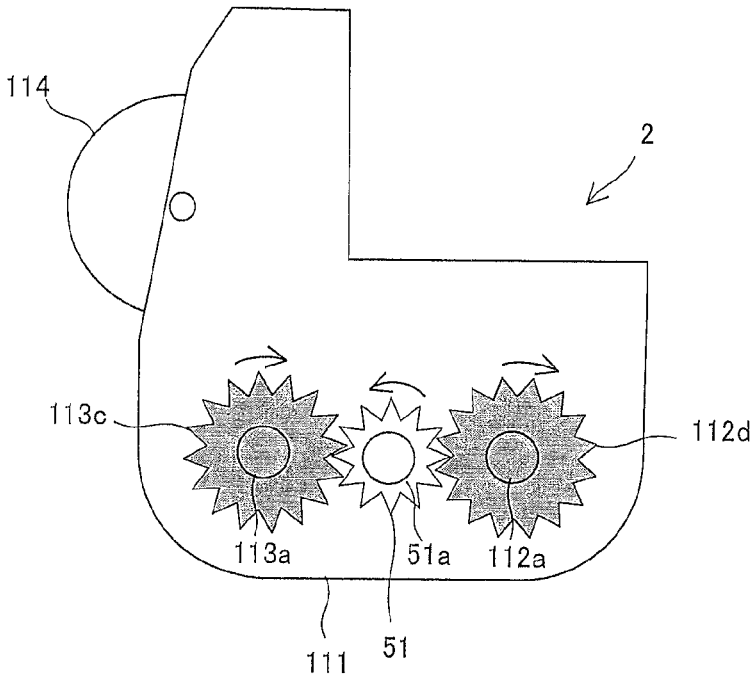
FIG. 6 is a sectional view of the developing device taken along a line D-D' in FIG. 3.

FIG. 2 is a sectional view illustrating an embodiment of the developing device illustrated in FIG. 1. FIG. 3 is a sectional view taken along a line A-A' in FIG. 2; FIG. 4 is a sectional view taken along a line B-B' in FIG. 2; FIG. 5 is a sectional view taken along a line C-C' in FIG. 3; and FIG. 6 is a sectional view taken along a line D-D' in FIG. 3. In these drawings, a developer stored in a developer tank 111 is not shown.

The developing device 2 has, in the developer tank 111, a developing roller 114 disposed so as to oppose the photoconductor drum 3. The developing device 2 supplies toner to the surface of the photoconductor drum 3 by means of the developing roller 114 to develop (make visible) an electrostatic latent image formed on the surface of the photoconductor drum 3.

As illustrated in FIG. 2, the developing device 2 includes the developer tank 111, the developing roller 114 for supplying the two-component developer to the photoconductor drum 3, a developer tank cover 115, a partition 117, developer conveyance members (112 and 113), a doctor blade 116 and a toner concentration detection sensor 119.

The developer tank 111 stores a developer including a toner and a magnetic carrier (two-component developer).

In the developer tank 111, the developing roller 114, the first conveyance member 112, the second conveyance member 113, the developer tank cover 115, the doctor blade 116 and the toner concentration detection sensor 119 are arranged at positions as illustrated in FIG. 2.

The carrier included in the developer usable for the present invention is a magnetic carrier having magnetism such as, for example, a ferrite carrier.

(Internal Configuration of Developer Tank)

In FIG. 2, the internal space of the developer tank 111 is divided into two chambers lying side by side in the horizontal direction by the partition 117 elongated in a direction parallel to the axial direction of the developing roller 114 (direction perpendicular to the surface of the page of FIG. 2). Out of the two chambers, the right chamber is a first developer conveyance path P, and the left chamber is a second developer conveyance path Q.

These two conveyance paths (P and Q) convey and circulate the two-component developer in pairs.

Preferably, the two conveyance paths are arranged in parallel.

In addition, as illustrated in FIG. 3, the first developer conveyance path P and the second developer conveyance path Q are long and narrow paths lying side by side which convey the developer in opposite directions and have a first communicating path a for guiding the two-component developer at a downstream side (right end in FIG. 3) in the first developer conveyance path P to the second developer conveyance path Q and a second communicating path b for guiding the two-component developer at a downstream side (left end in FIG. 3) in the second developer conveyance path Q to the first developer conveyance path P.

Thus, the first and second developer conveyance paths P and Q which are narrow and long in the lateral direction of the surface of the page of FIG. 3, and the first and second communicating paths a and b formed at opposite ends of the two conveyance paths for conveying the developer in the vertical direction of the surface of the page of FIG. 3 form one circular developer conveyance path.

As illustrated in FIG. 2, a lower part in the vertical direction, that is, a bottom of the developer tank 111 has semi-cylindrical inner wall surfaces respectively forming the first and second developer conveyance paths P and Q.

The developer tank 111 also has an opening for disposing the developing roller 114 between a side wall of the second developer conveyance path Q and a left end in FIG. 2 of the developer tank cover 115.

In FIG. 2, the first conveyance member 112 is provided in the first developer conveyance path P in a freely rotatable manner, and the second conveyance member 113 is provided in the second developer conveyance path Q in a freely rotatable manner. The two-component developer is conveyed by each of the conveyance members (112 and 113) in one direction.

The two conveyance members (112 and 113) have rotation axes (112*a* and 113*a*), which are arranged in parallel to each other with a predetermined space therebetween.

(Developing Roller)

In the opening formed at an upper part of the left chamber constituting the second developer conveyance path Q, the developing roller 114 is rotatably disposed so as to have a predetermined development nip part N between the developing roller 114 and the photoconductor drum.

The developing roller 114 is a magnet roller to be driven by drive means, not shown, to rotate about its axis in a direction of an arrow in FIG. 2 for bearing and supplying the two-component developer in the second developer conveyance path Q to the photoconductor drum 3.

A development bias voltage is applied from a power supply, not shown, to cause toner to adhere to an electrostatic latent image on the surface of the photoconductor drum 3 to develop the image.

After the developer is supplied to the photoconductor drum 3, the developer on the developing roller 114 comes off the surface of the developing roller 114 to fall into the second developer conveyance path Q.

(Doctor Blade)

As illustrated in FIG. 2, the doctor blade 116 is a rectangular plate-like member extending in parallel with the axial direction of the developing roller 114. A lower part thereof is fixed to a lower end of the opening of the developer tank 111 and an upper end 116*a* thereof is separated from the surface of the developing roller 114 with a predetermined gap. Examples of the material of the doctor blade 116 include stainless steel, aluminum and synthetic resin.

In addition, as illustrated in FIG. 2, the developer tank 111 has the detachable developer tank cover 115 that constitutes an upper wall of the developer tank.

In the developer tank cover 115, a toner supply port 115*a* is formed in order to supply unused toner to an upstream side in a developer conveyance direction (direction of an arrow X in FIG. 4) of the first developer conveyance path P (see FIGS. 3 and 4).

(Toner Concentration Detection Sensor)

As illustrated in FIG. 2, the toner concentration detection sensor 119 is attached to the semi-cylindrical inner wall surface of the developer tank 111 at a part vertically under the second conveyance member 113.

Furthermore, the toner concentration detection sensor 119 is disposed substantially in the center of the second developer conveyance path Q so that a sensor surface thereof exposes into the inside of the second developer conveyance path Q to contact with the developer in the second developer conveyance path Q.

The toner concentration detection sensor 119 is electrically connected to a toner concentration control unit, not shown.

The toner concentration control unit exerts control according to a toner concentration measurement value detected by the toner concentration detection sensor 119 so that a toner discharge member 122 of the toner supplying device 22 to be described later (see FIGS. 7 and 8) is driven to rotate and supply the toner from a toner discharge port 123 into the first developer conveyance path P of the developing device 2.

When the toner concentration control unit determines that the toner concentration measurement value detected by the toner concentration detection sensor 119 is lower than a predetermined toner concentration value, a control signal is transmitted to drive means that rotationally drives the toner discharge member 122 to rotate the toner discharge member 122.

Examples of the toner concentration detection sensor 119 usable here include general toner concentration detection sensors such as a transmitted light detection sensor, a reflected light detection sensor and a magnetic permeability detection sensor. In particular, the magnetic permeability detection sensor is preferable in terms of sensitivity.

The magnetic permeability detection sensor (toner concentration detection sensor 119) is connected to a power supply, not shown.

The power supply applies a driving voltage to the magnetic permeability detection sensor to drive the magnetic permeability detection sensor. The power supply also applies a control voltage to the magnetic permeability detection sensor to output a toner concentration detection result to the toner concentration control unit. The voltage application to the magnetic permeability detection sensor from the power supply is controlled by the toner concentration control unit.

The magnetic permeability detection sensor outputs the toner concentration detection result as an output voltage value in response to the application of the control voltage. Since the magnetic permeability detection sensor has basically good sensitivity near a median value of the output voltage, a control voltage that can provide an output voltage around such a value is applied.

This type of magnetic permeability detection sensor is commercially available, and examples thereof include product names TS-L, TS-A and TS-K by TDK Corporation.

The first conveyance member 112 includes the first rotation axis 112*a*, a first helical blade 112*b* fixed to the first rotation axis 112*a*, a first passive gear 112*c* provided to one end of the first rotation axis 112*a* protruded (extended) out of a wall surface of the developer tank 111 and a first pulley 112*d* being adjacent to the first passive gear 112*c* and fixed to the first rotation axis.

The second conveyance member 113 includes the second rotation axis 113*a*, a second helical blade 113*b* fixed to the second rotation axis 113*a*, a second passive gear 113*c* provided to one end of the second rotation axis 113*a* protruded (extended) out of the wall surface of the developer tank 111 and a second pulley 113*d* being adjacent to the second passive gear 113*c* and fixed to the second rotation axis.

Outside the developer tank, a rotation axis bending prevention belt 118 is provided so as to bridge the pulleys of the first rotation axis 112*a* and the second rotation axis 113*a*.

The term "to bridge" as used herein means that the belt is laid across so as to contact with the circumferences of the two pulleys (112*d* and 113*d*). In other words, the belt is looped around the pulleys.

The rotation axes, the helical blades, the passive gears and the pulleys are formed of rigid materials. Preferably, for example, they are formed of metals such as iron and stainless steel.

The pulleys (112*d* and 113*d*) are cylindrical members each having a diameter of, for example, approximately 10 mm to 15 mm and having a circumference sharing the same center with each rotation axis. The passive gears (112*c* and 113*c*) are members whose surfaces have teeth that engage with a drive gear 51 to be described later. The shorter the distance between the pulleys and the passive gears is, the more preferable. For example, the pulleys are in contact with the passive gears or the pulleys are disposed adjacent to the passive gears to form integrated parts.

As illustrated in FIGS. 3 and 5, the rotation axis bending prevention belt 118 is provided to bridge the first pulley 112*d* and the second pulley 113*d* so as to contact with both the circumferences of the pulleys. The belt 118 provided to bridge the two pulleys (112*d* and 113*d*) prevents the first rotation axis 112*a* and the second rotation axis 113*a* of the two conveyance members from bending in directions of increasing a distance L between the rotation axes.

When the distance L between the first rotation axis 112*a* and the second rotation axis 113*a* is designed to be 15 mm, for example, the distance L can be kept constant even when the first and second conveyance members (112 and 113) are in operation.

Preferably, the span and the alignment between the pulleys (112*d* and 113*d*) are appropriate enough to prevent the belt 118 therearound from rotating at idle. The appropriate span and alignment can prevent the belt 118 from meandering.

For example, when the developer tank and the first and second conveyance members (112 and 113) are assembled (but not rotated), and the gap between the inner wall of the developer tank and each of the helical blades of the first and second conveyance members is approximately 1.0 mm, the allowable bending of each conveyance member formed of a metal is 1.0 mm or less.

Without the belt, the conveyance members assembled (but not rotated) would bend by approximately 0.20 mm at ends of the rotation axes. With the belt 118, as in the case of the present invention, the bending of the rotation axes can be held to approximately 0.10 mm.

Since the bending of the rotation axes can be thus minimized by the belt, the helical blades and the inner wall of the developer tank can be prevented from contacting with each other when the conveyance members are rotated.

The first passive gear 112*c* and the second passive gear 113*c* are driven to be rotated by the drive gear 51 attached to an end of a rotation axis 51*a* connected to drive means (for example, motor), not shown.

As illustrated in FIG. 6, the drive gear 51 is disposed between the two passive gears (112*c* and 113*c*) so that the teeth thereof and the teeth of each passive gear engage with one another. When the drive gear 51 is rotated anticlockwise as shown in FIG. 6, both the two passive gears (112*c* and 113*c*) are rotated clockwise.

Accordingly, as the two passive gears (112*c* and 113*c*) are rotated, the belt 118 provided to bridge the rotation axes (112*a* and 113*a*) is also rotated in the same direction as the passive gears as shown in FIG. 5.

When the two passive gears (112*c* and 113*c*) are rotated as described above, the two rotation axes (112*a* and 113*a*) are rotated in the same direction as the passive gears while being prevented by the belt 118 from bending in the directions of increasing the distance L.

Further, the first helical blade 112*b* fixed to the first rotation axis 112*a* is also rotated as the rotation axis 112*a* is rotated, and as a result, the developer in the first developer conveyance path P is conveyed in the arrow X direction shown in FIG. 3.

On the other hand, the second helical blade 113*b* fixed to the second rotation axis 113*a* is also rotated as the rotation axis 113*a* is rotated, and as a result, the developer in the second developer conveyance path Q is conveyed in a direction of an arrow Y shown in FIG. 3.

Since the drive gear 51 is disposed between the two passive gears (112*c* and 113*c*) as illustrated in FIG. 6, the conveyance members are prevented from bending in directions of reducing a distance between the passive gears, that is, the distance L between the two rotation axes (112*a* and 113*a*).

As described above, the conveyance members are prevented from bending also in the directions of increasing the distance L between the two rotation axes (112*a* and 113*a*) by the belt 118 provided to bridge the circumferences of the two pulleys (112*d* and 113*d*).

Since the distance L between the two rotation axes (112*a* and 113*a*) is kept constant by the mechanism including the two passive gears (112*c* and 113*c*) and the pulleys (112*d* and 113*d*) adjacent to the passive gears as illustrated in FIG. 3, a distance between the rotation axes at areas within the two conveyance paths (112 and 113) where the helical blades (112*b* and 113*b*) are fixed to the rotation axes is also kept constant, thereby to prevent the helical blades from contacting with the inner wall of the developer tank.

Since the helical blades are thus prevented from contacting with the inner wall, the toner in the conveyance paths can be prevented from aggregation.

In the mechanism of rotating the two conveyance members by means of the passive gears as illustrated in FIG. 3, the passive gears are subjected to the force that causes the bending of the rotation axes.

The passive gears (112*c* and 113*c*), which are subjected to the force, are therefore disposed adjacent to the pulleys (112*d* and 113*d*) bridged with the belt 118. Thus, the bending-prevention effect can be enhanced.

<Configuration of Toner Supplying Device>

Figure 7:
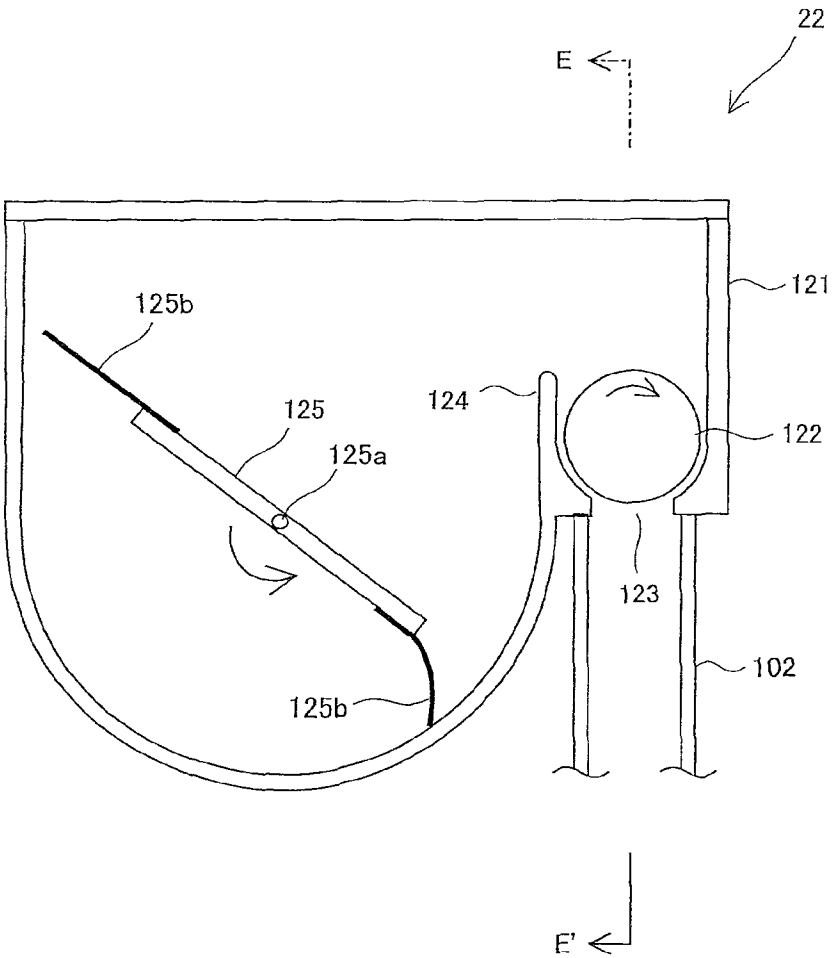
FIG. 7 is a schematic sectional view illustrating a configuration of an embodiment of a toner supplying device in a developing device of the present invention.
Figure 8:
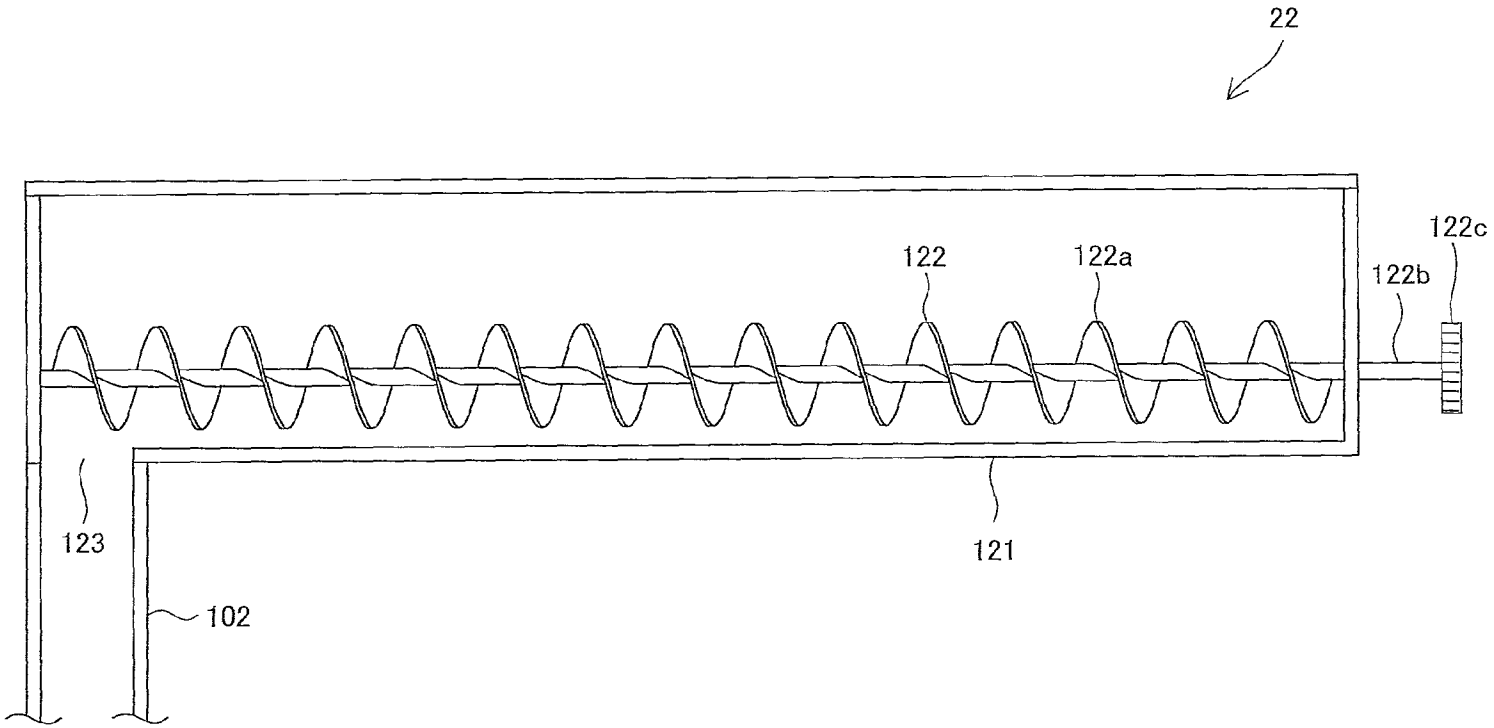
FIG. 8 is a sectional view of the toner supplying device taken along a line E-E' in FIG. 7.

FIG. 7 is a schematic sectional view illustrating an embodiment of a toner supplying device in the developing device of the present invention. FIG. 8 is a sectional view of the toner supplying device illustrating a section around the toner discharge port taken along a line E-E' in FIG. 7.

As illustrated in FIGS. 7 and 8, the toner supplying device 22 includes a toner container 121 having the toner discharge port 123, a toner agitation member 125 and the toner discharge member 122, and accommodates unused toner therein.

As illustrated in FIG. 1, the toner supplying device 22 is disposed above the developer tank 111 of the developing device 2, and the toner discharge port 123 and the toner supply port 115*a* of the developing device 2 are connected via a toner conveyance pipe 102 (see FIGS. 4 and 7). The toner container 121 is a substantially semi-cylindrical container member having an internal space, and the toner discharge port 123 is disposed at a lateral position in a circumferential direction of the semi-cylindrical part.

The toner agitation member 125 is rotatably disposed at a substantially central position in the semi-cylindrical part of the toner container 121, and the toner discharge member 122 is rotatably disposed above and near the toner discharge port 123.

The toner agitation member 125 is a plate-like member that rotates about a rotation axis 125*a*, and the toner agitation member 125 has sheet-like toner drawing members 125*b* made of flexible resin (for example, polyethylene terephthalate) at both leading ends away from the rotation axis 125*a*. The rotation axis 125*a* is rotatably supported on sidewalls on both sides in the longitudinal direction of the toner container 121, and one end of the rotation axis 125*a* penetrates the sidewall and has a gear fixed thereto and being in meshing engagement with a driving gear of drive means, not shown.

Upward rotation of the toner drawing members 125*b* with respect to the toner discharge port 123 allows the toner agitation member 125 to simultaneously agitate and draw the toner stored in the toner container 121 to convey the toner to the toner discharge member 122.

On this occasion, the toner drawing members 125*b* rotate to supply the toner to the side of the toner discharge member 122 while sliding along the inside wall of the toner container 121 and being deformed due to its flexibility.

The toner discharge member 122 and the toner agitation member 125 have a partition 124 therebetween. Thereby, an appropriate amount of toner drawn by the toner agitation member 125 can be held around the toner discharge member 122.

The toner discharge member 122 supplies the toner in the toner container 121 to the developer tank 111 through the toner discharge port 123. As illustrated in FIG. 8, the toner discharge member 122 includes a rotation axis 122*b* whose both ends are rotatably supported on sidewalls on both sides in the longitudinal direction of the toner container 121, a helical blade 122*a* fixed to the outer circumferential surface of the rotation axis 122*b* and a gear 122*c* fixed to the rotation axis 122*b* at one end that penetrates the sidewall of the toner container 121. The gear 122*c* is in meshing engagement with a driving gear of driving means, not shown.

The toner discharge port 123 of the toner container 121 is disposed at one end side of the helical blade 122*a* opposite to the side of the gear 122*c*.

Rotation of the toner discharge member 122 allows the toner supplied around the toner discharge member 122 to be conveyed by the helical blade 122*a* toward the toner discharge port 123 and to be supplied from the toner discharge port 123 into the developer tank 111 of the developing device 2 through the toner conveyance pipe 102.

<Description of Actions for Conveying Developer by Developing Device>

In a developing step with the image forming apparatus, as illustrated in FIGS. 2, 5 and 6, the developing roller 114, the first conveyance member 112 and the second conveyance member 113 of the developing device 2 are rotated in the directions of the arrows shown in FIG. 2, respectively.

As a result of the rotation of these members, the helical blade 112*b* of the first conveyance member 112 conveys the developer in the first developer conveyance path P in the arrow X direction shown in FIGS. 3 and 4. At the same time, the helical blade 113*b* of the second conveyance member 113 conveys the developer in the second developer conveyance path Q in the arrow Y direction shown in FIG. 3.

During the conveyance, the developer conveyed to the downstream side of the first developer conveyance path P is sent to the second developer conveyance path Q through the first communicating path a shown in FIG. 3, and the developer conveyed to the downstream side of the second developer conveyance path Q is sent to the first developer conveyance path P through the second communicating path b.

Some of the developer moved in the second developer conveyance path Q is supplied to the development roller 114.

The developer supplied to the developing roller 114 is formed into a developer layer having a predetermined uniform thickness on the outer circumferential surface of the developing roller 114 by the doctor blade 116 and sent to the photoconductor drum 3. From the developer layer, some of the toner is supplied to the photoconductor drum 3.

After an electrostatic latent image on the photoconductor drum 3 is developed, the developer left on the surface of the developing roller 114 falls off into the second developer conveyance path Q.

The toner concentration of the developer is detected by the toner concentration detection sensor 119. When the toner concentration in the second developer conveyance path Q falls to a predetermined value, therefore, unused and new toner is supplied from the toner supplying device 22 onto the developer at the upstream side of the first developer conveyance path P, which is in the vicinity of the second communicating path b.

Thus, the two-component developer having a lowered toner concentration in the first developer conveyance path P will be supplied with the new toner in the vicinity of the second communicating path b.

What is claimed is:

1. A developing device comprising:

a developer tank for containing a two-component developer;

a partition for dividing an internal space of the developer tank;

a first developer conveyance path and a second developer conveyance path which are separated by the partition and arranged in parallel for conveying and circulating the two-component developer in pairs, a first conveyance member provided in the first developer conveyance path in a freely rotatable manner for conveying the two-component developer in one direction, the first conveyance member having:

a first rotation axis;

a first helical blade fixed to the first rotation axis; and a first passive gear provided to an end of the first rotation axis extended out of the developer tank;

a second conveyance member provided in the second developer conveyance path in a freely rotatable manner for conveying the two-component developer in one direction, the second conveyance member having:

a second rotation axis;

a second helical blade fixed to the second rotation axis; and a second passive gear provided to an end of the second rotation axis extended out of the developer tank;

a first communicating path for guiding the two-component developer in the first developer conveyance path to the second developer conveyance path;

a second communicating path for guiding the two-component developer in the second developer conveyance path to the first developer conveyance path;

a developing roller for bearing and supplying the two-component developer in the second developer conveyance path to a photoconductor drum; and a rotation axis bending prevention belt provided so as to be put around with tension applied the first rotation axis and the second rotation axis outside the developer tank.

2. The developing device according to claim 1, wherein the first conveyance member and the second conveyance member include a first pulley and a second pulley fixed to the first rotation axis and the second rotation axis, respectively, and the rotation axis bending prevention belt is provided so as to contact with circumferences of the first and second pulleys.

3. The developing device according to claim 2, wherein the first and second pulleys are disposed adjacent to the first and second passive gears, respectively.

4. An image forming apparatus comprising a developing device according to claim 1.

5. The image forming apparatus according to claim 4, comprising:

a photoconductor drum having a surface on which an electrostatic latent image is formed;

a charger for charging the surface of the photoconductor drum;

an exposure device for forming the electrostatic latent image on the surface of the photoconductor drum;

a toner supplying device for supplying a toner to the developing device;

a drive gear for driving the first and second passive gears of the developing device;

a transfer device for transferring, to a recording medium, a toner image formed on the surface of the photoconductor drum by the developing device with the toner supplied from the toner supplying device; and a fixing device for fixing the transferred toner image onto the recording medium.

6. The image forming apparatus according to claim 5, wherein the drive gear is disposed between the first and second passive gears so as to engage with the passive gears.

* * * * *